US005727857A

United States Patent [19]

Smith

[11] Patent Number: 5,727,857

[45] Date of Patent: Mar. 17, 1998

[54] PORTABLE KNOCKDOWN FOOD DISPLAY APPARATUS

[76] Inventor: Lorena D. Smith, 2 Amherst St., Red Hook, N.Y. 12571

[21] Appl. No.: 736,204

[22] Filed: Oct. 25, 1996

Related U.S. Application Data

[60] Provisional application No. 60/006,247, Nov. 7, 1995.

[51] Int. Cl. [6] ..... A47B 77/16

[52] U.S. Cl. ..... 312/114; 220/23.86; 62/372; 312/128; 312/229; 312/324; 312/351.3; 312/240

[58] Field of Search ..... 206/546, 549, 206/545, 542, 541; 220/23.86; 62/372, 457.6, 457.1, 459; 211/184; 312/102, 114, 128, 126, 229, 324, 351.3, 240, 138.1, 132, 117, 293.1, 293.3; 108/14, 26, 24, 158; 190/11, 12 R, 110, 12 A

[56] References Cited

U.S. PATENT DOCUMENTS

| | | | |
|---|---|---|---|
| 1,176,473 | 3/1916 | Loring | 190/11 |
| 1,402,602 | 1/1922 | Hansen | 312/229 X |
| 1,562,855 | 11/1925 | Tinkess | 190/12 R |
| 2,083,852 | 6/1937 | McClanahan | 312/229 X |
| 2,473,047 | 6/1949 | Bershad | 190/11 X |
| 2,522,322 | 9/1950 | Wallace | 312/351.3 X |
| 3,020,113 | 2/1962 | Molitor . | |
| 3,130,288 | 4/1964 | Monaco et al. | 206/546 X |
| 3,241,706 | 3/1966 | Monaco et al. | 108/44 X |
| 3,331,524 | 7/1967 | Wiley, Jr. . | |
| 3,424,510 | 1/1969 | Moon . | |
| 3,687,092 | 8/1972 | Manning | 108/158 X |
| 4,085,987 | 4/1978 | Vartdal | 312/229 X |
| 4,346,806 | 8/1982 | Bustos | 211/184 X |
| 4,407,143 | 10/1983 | Wolfe . | |
| 4,572,598 | 2/1986 | Moore, Jr. . | |
| 4,574,594 | 3/1986 | Simmons et al. | 62/457.1 |
| 4,706,817 | 11/1987 | Greathouse | 206/546 X |
| 4,802,340 | 2/1989 | Johnson . | |
| 4,852,741 | 8/1989 | Van Benschoten . | |
| 5,171,077 | 12/1992 | Jondahl et al. | 312/324 X |
| 5,247,807 | 9/1993 | Jarman et al. . | |

*Primary Examiner*—Peter M. Cuomo
*Assistant Examiner*—Janet M. Wilkens
*Attorney, Agent, or Firm*—Richard C. Litman

[57] ABSTRACT

A portable knockdown display apparatus for displaying food and keeping the food fresh on ice during use of the apparatus. The apparatus includes a rack for holding food receptacles, a cover removably seated on the rack for protecting the food receptacles, a plurality of individual legs, and a container having a bottom and a plurality of sidewalls that define a cavity for retaining ice during use of the apparatus. The container has a plurality of attachment wells for releasably attaching the legs to the container so that the container is elevated to table height. During use of the apparatus, the container is capable of receiving the rack in its cavity to maintain the food receptacles in physical proximity to the ice. When knocked down into a portable formation, the container is capable of receiving the rack, the cover, and the legs in its cavity to facilitate ease of transportation and storage. A number of straps are used removably to secure the apparatus in its portable formation, and a handle on the sidewall of the container allows a user easily to carrying the apparatus.

16 Claims, 7 Drawing Sheets

PORTABLE KNOCKDOWN FOOD DISPLAY APPARATUS

BACKGROUND OF THE INVENTION

The present invention is based upon the Provisional Patent application Ser. No. 60/006,247 filed Nov. 7, 1995.

1. Field of the Invention

The present invention relates generally to a self-service food display and serving device. More specifically, the invention relates to a portable knockdown food display apparatus for displaying salads and other food items fresh on ice at outdoor picnics and dinner parties. The food display apparatus of the present invention is designed to be easily assembled, disassembled, carried, and stored.

2. Description of the Prior Art

The prior art illustrates an abundance of food serving apparatus, many of which disclose salad bars. Typically, the salad bars have an electrical or ice refrigerating system that keeps the salad condiments chilled. Those salad bars that are found in restaurants and supermarkets are generally large and, due to their size, rather difficult to move. The prior art also contains tabletop salad bars and portable salad bars, however, the prior art fails to disclose portable salad bars that have a table integral to the salad bar's design. In addition, the prior art fails to describe a portable knockdown display apparatus with handles on the exterior of the apparatus that enable the carrying of the apparatus when it is broken down into its portable formation. Thus, there is a need for a portable display apparatus that is compact and easily carried when it is broken down into its portable formation, yet also is easily convertible into a fully functional, self-supporting food display capable of refrigerating food on ice.

U.S. Pat. No. 3,020,113, which issued to Victor D. Molitor on Mar. 17, 1958, and U.S. Pat. No. 3,424,510, which issued to Herbert J. Moon on Jan. 28, 1969, illustrate portable food carts having a transparent plastic sanitary bubble top that permit the covering of food items while the food items are displayed. Neither of the carts are provided with the ability to refrigerate the food, nor are they capable of being knocked down into a portable formation.

U.S. Pat. No. 3,331,524 which issued to Nathaniel C. Wiley, Jr., on Jul. 18, 1967, illustrates a window box for potted plants with adjustable support means for supporting multiple flower pots of various sizes.

U.S. Pat. No. 4,407,143 which issued to John J. Wolfe on Oct. 4, 1983, discloses a frosted condiment holder having refrigerant lines in contact with a top plate for forming a layer of frost on the top plate such that it appears as if the condiments are resting in ice. A cooled storage area beneath the top plate maintains the condiments in a fresh condition. In addition, the condiment holder provides a self-draining water flush system along the base of the holder for flushing the base with water from a pair of water jets in the base. However, the condiment holder is not portable and it does not show a transparent plastic bubble or dome for covering the condiments.

U.S. Pat. No. 4,572,598 which issued on to Franklin Moore, Jr., on Feb. 25, 1986, describes a self-serve salad bar for supermarkets and restaurants. The salad bar comprises a table for holding ice and condiments, a supporting base for mounting the table, and a movable cover member. While adjustable, the cover member is not readily adapted for repeated opening and closing to provide access to the condiments. Also, the disclosed salad bar is not disposed for portable usage.

U.S. Pat. No. 4,802,340 which issued to Thomas M. Johnson on Feb. 7, 1989, discloses a refrigerated salad bar that has a refrigeration unit mounted inside the structure of the salad bar. The salad bar is provided with a hood to protect against contamination, however, no full covers are provided for the condiments. Also, the salad bar is not disposed for portable usage.

U.S. Pat. No. 5,247,807 which issued to Ronnie T. Jarman et al. on Sep. 28, 1993, discloses a salad bar with replaceable modular refrigerated condiment containers. The containers have a temperature control circuit connected to a refrigeration means mounted in the modular refrigerated condiments container. The refrigeration means maintain the condiments holders and the food contained in the containers at a desirable cool temperature. The salad bar disclosed is not portable and does not show adjustable condiment container support means.

U.S. Pat. No. 4,852,741 which issued to Doris G. Van Benschoten on Aug. 1, 1989, discloses a portable table top salad bar which is used to keep salads fresh on ice at parties and picnics. The salad bar is lightweight, has collapsible portions, is easily assembled and disassembled, and is relatively easy to transport. However, when disassembled the salad bar is not collapsible into a convenient carrying case. The salad bar has a plurality of holes for receiving a nozzle or valve for draining off water. The salad bar also has two bottom sections, a vinyl bottom liner, and two dome-shaped lids for closing the top opening. However, the salad bar does not disclose a table integral to the salad bar's design or a built-in drain for expelling water. In addition, the salad bar as disclosed does not show a clear dome top with right and left side lids.

None of the above inventions and patents, taken either singly or in combination, is seen to describe the instant invention claimed.

SUMMARY OF THE INVENTION

The present invention is a portable knockdown food display apparatus that is particularly disposed for use as a salad bar at parties and picnics. The apparatus is preferably formed of thermoplastic materials which are both lightweight and durable, thereby producing components which are ideal for the intended purposes. The apparatus comprises a container, a food rack, a cover, and a plurality of legs. The container has a plurality of sidewalls integral with a sloped bottom that tapers to a plugged opening for the drainage of water. Together the sidewalls and the bottom define a cavity which serves two functions: it stores ice for maintaining food fresh during use of the apparatus and it stores the other components of the apparatus during storage or transportation of the apparatus. The container also has a number of receiving wells that releasably receive the legs of the apparatus to elevate the container to table height.

Ice is placed into the container so that the ice reaches a depth of no higher than the tops of the receiving wells. The tops of the receiving wells, located within the cavity of the container, support the adjustable food rack so that any food receptacles thereon are in physical proximity to the ice in the cavity. The cover is preferably formed of a transparent material to allow users to view the food therein without removing the cover. The cover has a collar for contacting the food rack and a dome which extends upwardly from the collar. The dome has opposed side lids for forming an enclosure when the lids are in a closed position, as well as providing access to the food items when the lids are in an open position.

To knock down the portable display apparatus, the legs are removed from the receiving wells and the food rack and cover are separated from the container. Any ice and water inside the cavity of the container should be poured from the container. With the container having its cavity upright, a pair of legs are first inserted into the cavity, followed by the cover in an inverted position. A second pair of legs are inserted into the dome portion of the cover, and finally the food rack is inserted into the cavity. To secure the components in the container cavity, a pair of flexible straps are wrapped around the container and its ends are connected together by any conventional means, such as hook and loop type closure means. A handle provided on the outside of the sidewalls allows the portable display apparatus to be carried when it is in its knocked down or portable formation.

Accordingly, it is a principal object of the invention to provide a portable knockdown food display apparatus for refrigerating foods on ice at a picnic or party.

It is another object of the present invention to provide a portable knockdown food display apparatus having a container with a sloped bottom for drainage of liquids.

It is a further object of the present invention to provide a portable knockdown food display apparatus having an adjustable food rack capable of holding different sized food receptacles.

It is another object of the present invention to provide a portable knockdown food display apparatus having a transparent dome shaped cover for covering any food, whereby the cover has opposed lids for providing access to the foodstuff when the lids are in the open position and for protecting food from contamination while in the lids are in the closed position.

It is also an object of the present invention to provide a portable knockdown food display apparatus having a plurality of legs that are removably attached to the container for elevating the container to table height.

It is also an object of the present invention to provide a portable knockdown food display apparatus having leg attachment wells in the bottom corners of the container for supporting the food rack so that food receptacles in the food rack are maintained in physical proximity to the ice.

It is another object of the present invention to provide a portable knockdown food display apparatus whereby the legs, the cover, and the food rack are capable of being secured within the container during storage and transportation of the apparatus.

It is a further object of the present invention to provide a portable knockdown food display apparatus having a container with handles on the exterior of its sidewall to enable carrying of the apparatus while it is in the broken down formation.

It is an object of the invention to provide improved elements and arrangements thereof in an apparatus for the purpose described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
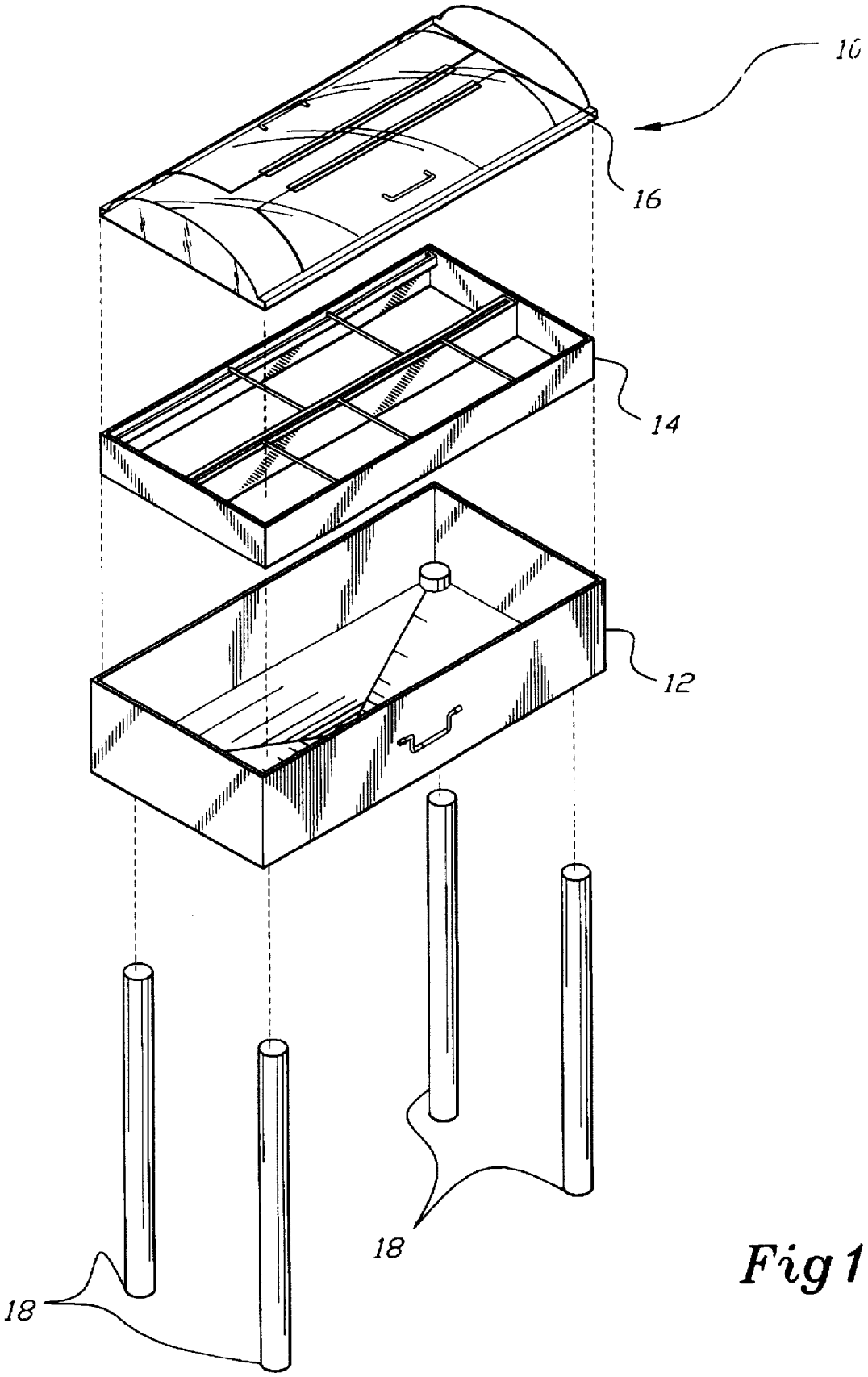
FIG. 1 is an exploded perspective view of the portable knockdown display apparatus of the present invention.

Referring to the figures by numerals of reference and first to FIG. 1, 10 denotes generally a portable knockdown display apparatus for displaying food and keeping the food fresh on ice. The display apparatus 10 is particularly useful as a salad bar for outdoor picnics and barbecues, however, it also may be used as a display case at outdoor and indoor events. Because the apparatus is used to maintain food fresh on ice, it will be necessary to utilize a bucket or the like for catching water released from the apparatus when it is used indoors. When used outdoors, the water may drip directly onto the ground.

The portable knockdown apparatus 10 of the present invention generally comprises a container 12, a food rack 14, a cover 16, and a plurality of elongate legs 18. It should be appreciated that the number of legs required to support the portable display apparatus will depend upon its size and dimension. As shown in the accompanying figures, a rectangular shaped container 12 requires only four legs 18. It should be apparent, however, that a differently shaped apparatus may require a different number of legs and that a larger container 12 may require a greater number of legs.

Preferably the container 12, the rack 14, the cover 16, and the legs 18 are formed of a lightweight yet durable thermoplastic material. Thermoplastic polymers are preferable to metal or wood materials because the thermoplastics are substantially lighter than wood or metal, and thus render the apparatus lightweight for its transportation. Also, the plastics provide significantly greater temperature insulation over metals, and therefore are preferred for storing ice and cooling the food contained inside the apparatus.

Figure 4:
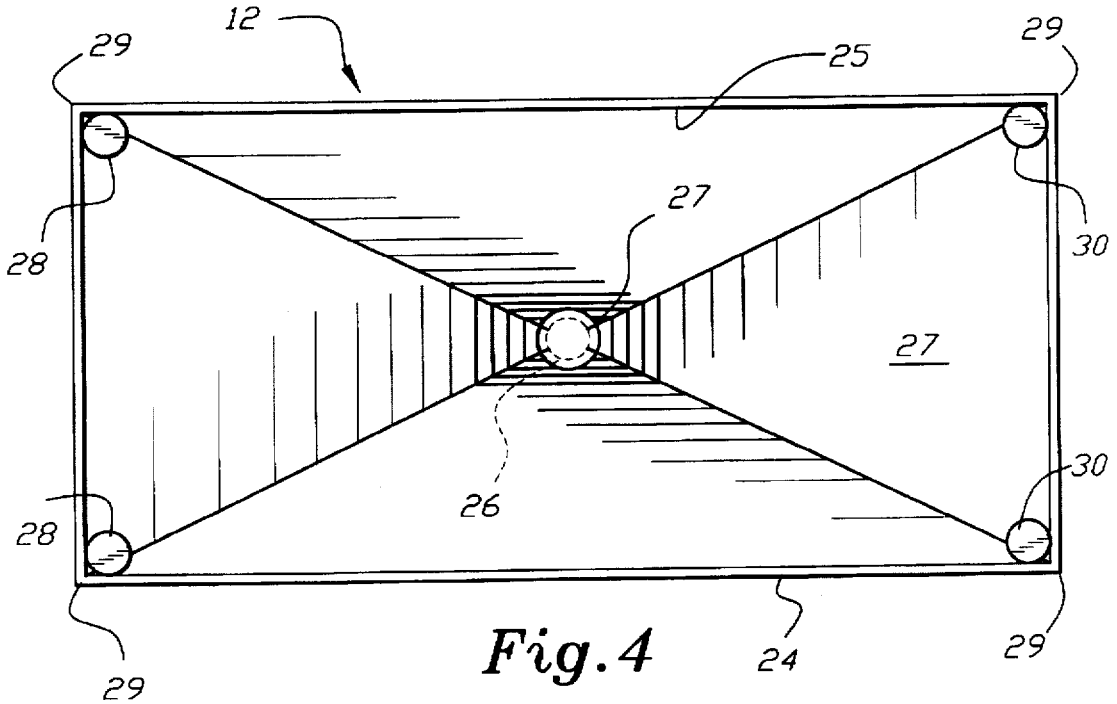
FIG. 4 is a top plan view of the container of the present invention.

Referring specifically now to FIG. 4, the container 12 comprises a bottom 22 with a plurality of sidewalls 24 integral with the upper side of the bottom. Together, the bottom and sidewalls define a cavity 25 for retaining ice during use of the apparatus and, as discussed hereinafter, for retaining the rack 14, the cover 16, and the legs 18 during transportation and storage of the apparatus. To provide for water drainage during use of the display apparatus 10, the bottom 22 is provided with an opening 26 therethrough which is located centrally thereof. To prevent undesired water leakage during use of the apparatus, the opening 26 is provided with a stopper or plug 27. A press fit for the stopper is sufficient to close the opening 26, however, a threaded connection also may be used. Regardless of the type of connection between the stopper and the bottom 22, removal of the stopper allows a user to drain liquids from the container 12 as desired. To facilitate the drainage of liquids, the bottom 22 slopes from all directions toward the opening 26 (i.e., sloping downwardly from the sidewalls to the opening).

Figure 8A:
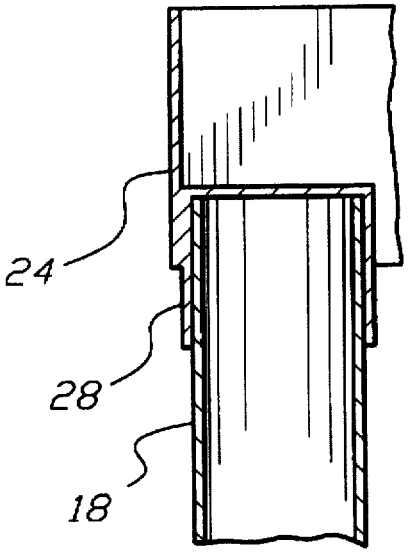
FIG. 8A is an enlarged fragmentary cross sectional view of a frictional connection between the leg and the receiving well.
Figure 8B:
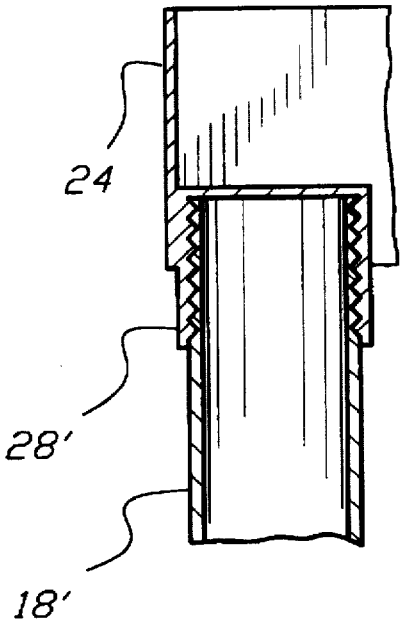
FIG. 8B is an enlarged fragmentary cross sectional view of a threaded connection between the leg and the receiving well.

At the point where adjacent sidewalls 24 intersect with the bottom 22 to form a corner of the container 12, each corner is provided with leg attaching means in the form of an attachment well 28. Each attachment well 28 is disposed releasably to receive one of the ends of the legs 18 during use of the apparatus as a display case. Thus, the number of attachment wells 28 is equal to the number of legs 18. Each of the legs 18 is preferably between about thirty-six to forty-two inches long, thereby elevating the container to table height. As shown in FIG. 8A, one means for connecting together the end of the leg 18 and the container 12 is a frictional connection between the attachment well 28 and the leg 18. The attachment wells 28 are provided with an inner dimension corresponding to the perimeter of the legs, whereby the attachment wells frictionally receive the end of the legs. The frictional engagement allows the legs 18 to support the container, for example, upon a horizontal surface during use of the apparatus, while also allowing the legs 18 to be removed when knocking down the apparatus. As an alternative means for connecting together the legs and the container, FIG. 8B shows a threaded connection between the attachment well 28' and the leg 18'. The leg 18' is provided with one if its ends having a threaded outer diameter, and the attachment well 28' is provided with a threaded inner diameter. Thus, the threaded connection allows the legs 18' to support the container during its use as a display apparatus, while also allowing the legs 18' to be removed when knocking down the apparatus. The threaded connection also has an added benefit of providing some freedom to adjust the connection to accommodate for the placement of the apparatus upon an uneven surface. Thus, if the apparatus is unstable, one or two legs may be adjusted to level the container.

Figure 2:
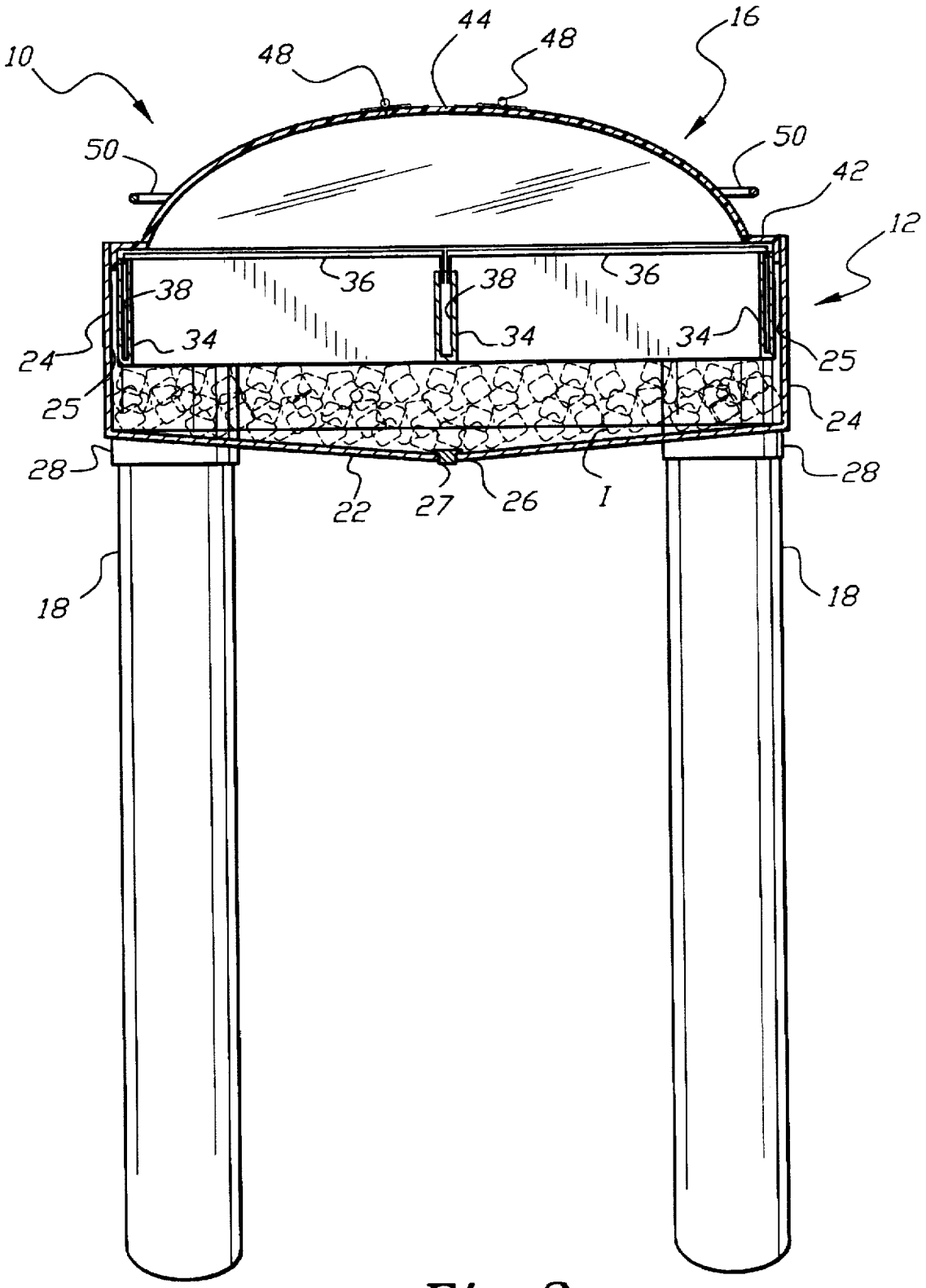
FIG. 2 is a cross-sectional view of the assembled apparatus.
Figure 3:
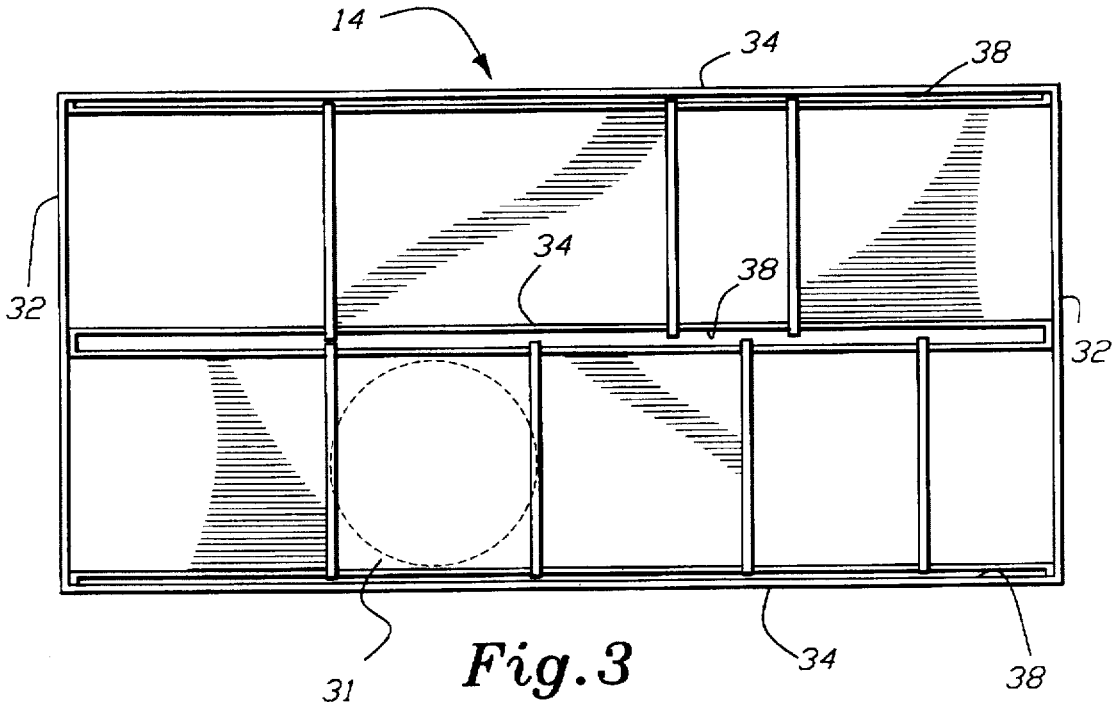
FIG. 3 is a top plan view of the adjustable food rack of the present invention.

Referring specifically now to FIG. 3, the food rack 14 for holding a multiplicity of food receptacles 31 is illustrated. The food rack 14 comprises a pair of opposed end rails 32, a plurality of spaced longitudinal rails 34 extending between and connected to the rails, and a multiplicity of support rails 36 mounted upon adjacent longitudinal rails for providing support to the food receptacles 31. Preferably the food rack is one which allows the support rails 36 detachably and slidably to be mounted upon adjacent longitudinal rails 34 for adjustably accommodating various sizes of said food receptacles 31. Any method for achieving the detachable and slidable mounting of the support rails may be used, however, as shown in the FIG. 2, each of the longitudinal rails 34 are provided with a groove 38 extending the length of the rail. The grooves 38 are disposed to receive the ends of the support rails 36 to allow the support rails to be moved along the length of the longitudinal rails or completely removed therefrom.

Figure 5:
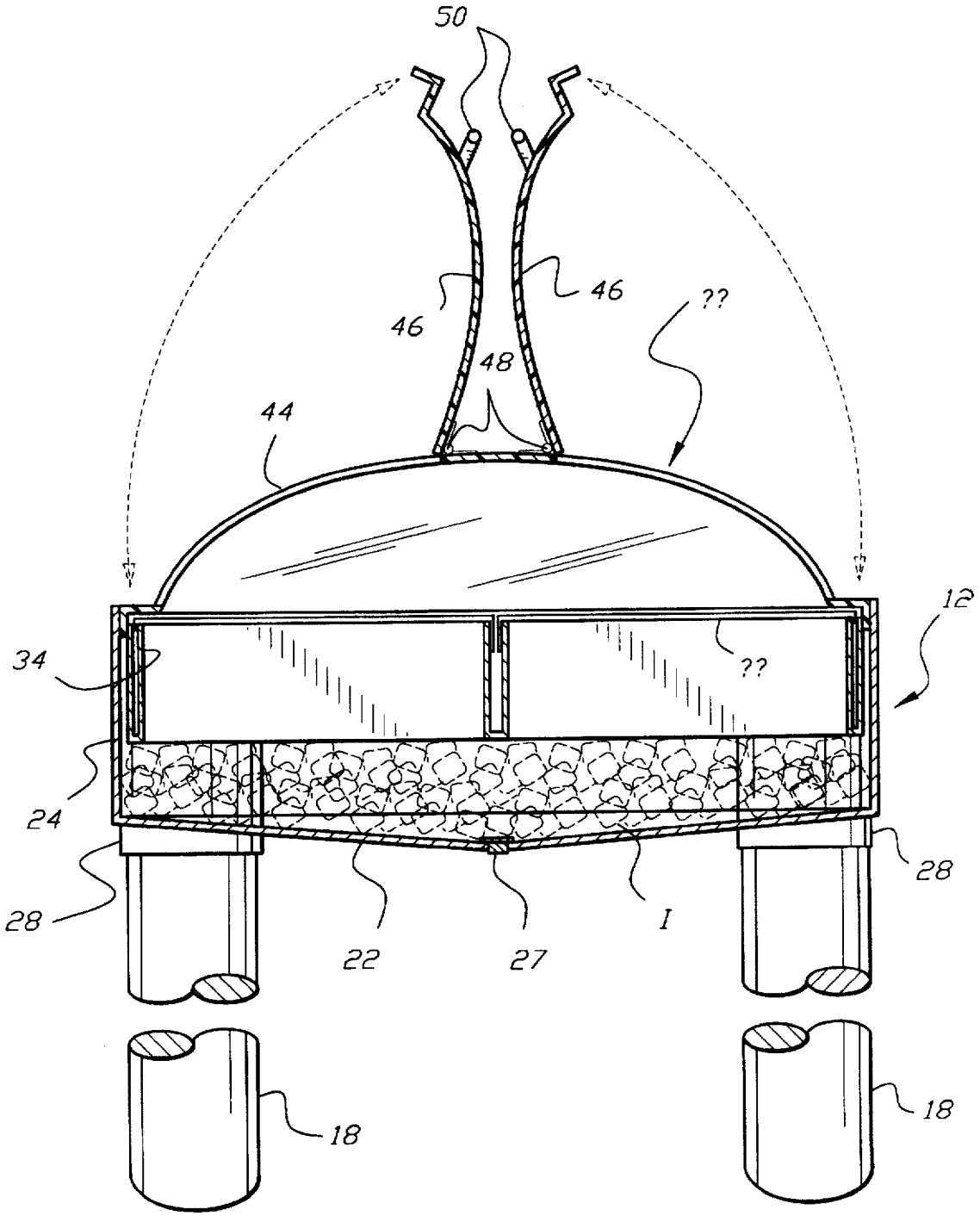
FIG. 5 is an enlargement cross sectional view of the cover of the present invention with its lids in the open position.

As shown in FIGS. 2 and 5, the cover 16 is removably seated upon the rack 14 for protecting the food stored within the receptacles during use of the apparatus. Preferably the cover is transparent to allow users to view the contents of the various food receptacles supported by the rack 14. The cover has a collar 42 which rests upon the rack 14, and a transparent dome 44 which extends upwardly from the collar. The dome has a pair of lids 46 (also transparent), each of which is attached to the dome along a hinged connection 48 for manipulation of the lids. Each of the lids is provided with a handle 50 that allows a user to manipulate the lids (as indicated by the arrows in FIG. 5) between a closed position where the food receptacles are inaccessible and an open position where the food receptacles are accessible.

To assemble the portable knockdown apparatus of the present invention, a user should first assemble the container and leg connections. One end of each leg 18, 18' is inserted into a corresponding leg attachment well 28, 28' where it is releasably received during use of the display apparatus. Following insertion of all legs into the attachment wells, the container 12 is capable of standing freely upon its legs. Ice should be dumped into the cavity 25 of the container and leveled to the height of the top 30 of the attachment wells. With the ice properly leveled, the rack 14 may be placed into the cavity where it is supported upon the tops 30 of the attachment wells. Any food receptacles 31 may be placed onto the support rails 36 so that the food receptacles are maintained in physical proximity to the ice during use of the apparatus. This ensures that any food contained within the receptacles will be maintained in a fresh condition. Following placement of the food receptacles, the cover 16 is placed over the rack 14 such that the collar 42 rests upon the perimeter of the rack (i.e., upon the end rails and outer longitudinal rails). When access to the food is not desired, the lids 46 of the dome should remain in their closed position. Thus, any insects or other contaminants cannot contact the food.

Figure 6:
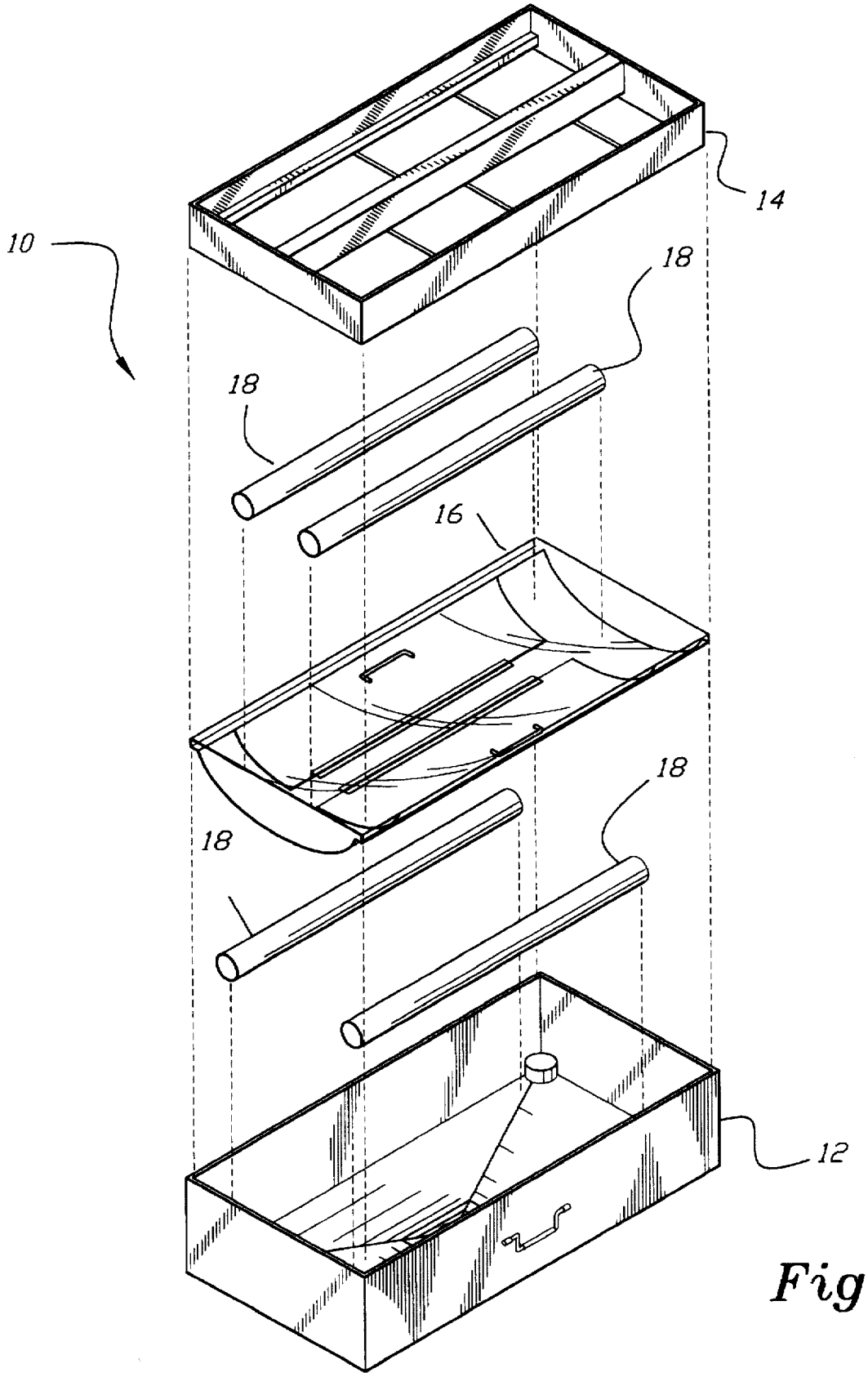
FIG. 6 is an exploded perspective view of the present invention disassembled and aligned for placement into its storage formation.
Figure 7:
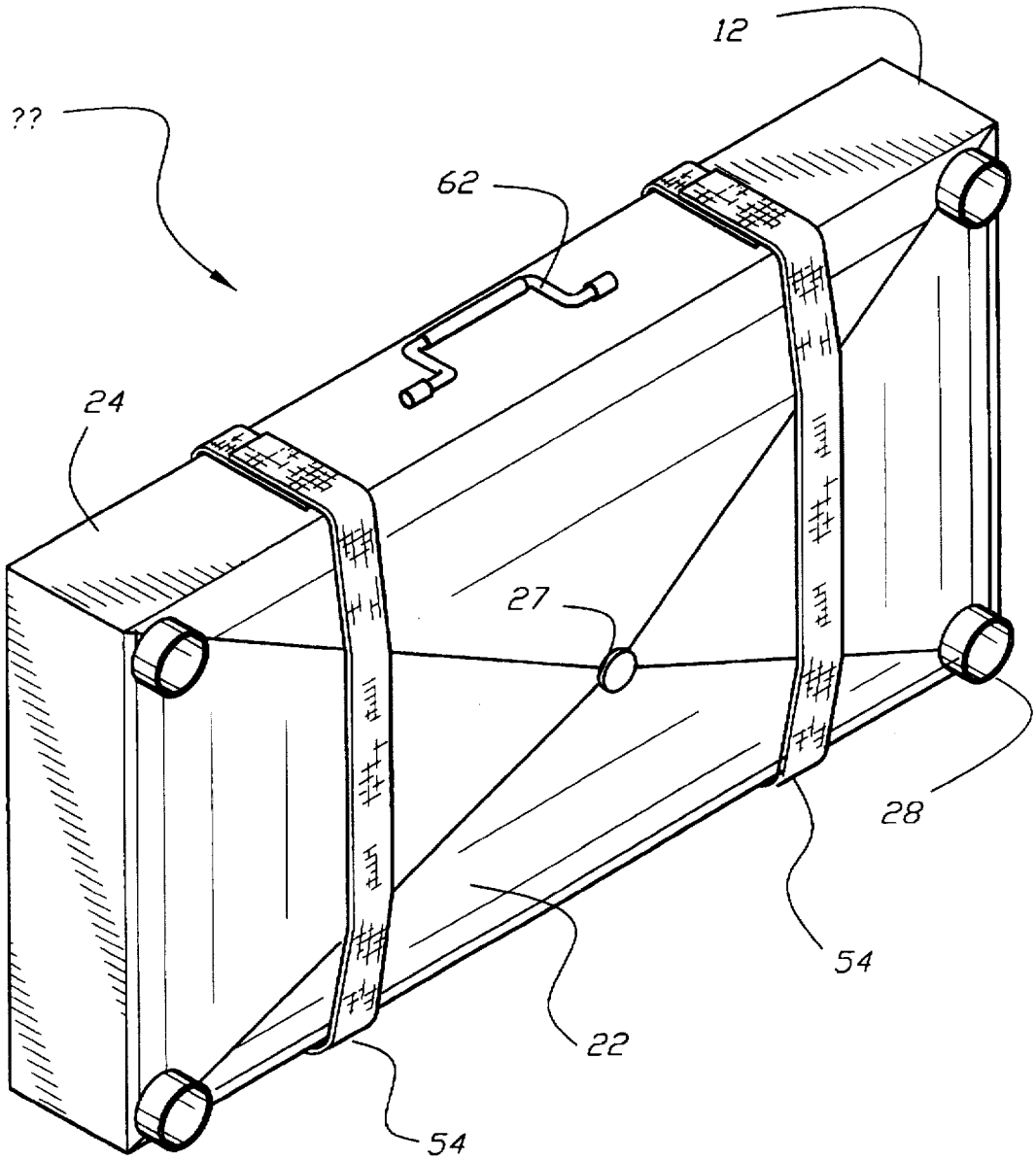
FIG. 7 is a perspective view of the present invention disassembled and placed into its storage formation.

To disassemble or knockdown the apparatus following its use, the cover 16 should first be removed, followed by the rack 14 and any food receptacles 31 supported thereby. With the rack and cover removed, any ice remaining in the cavity 25 should be removed by dumping the contents of the container. Finally, each of the legs 18, 18' should be removed from the attachment wells 28, 28' on the container. As shown in FIG. 6, the cavity 25 is capable of receiving the rack, the cover, and the legs during transportation and storage of the apparatus. A pair of legs 18, 18' is placed into the cavity 25, followed by the cover 16, which has been inverted so that its dome 44 fills the region between the tops of the attachment wells and the sloped bottom. A second pair of legs 18, 18' is placed onto the inverted cover 16, which is now within the cavity 25. Finally, the rack 14 is inverted and inserted into the cavity 25 so that it contacts the inverted cover 16. In this position, the container 12, rack 14, cover 16, and legs 18, 18' should be removably secured together by Securing means. The preferred securing means comprise a pair of flexible fabric straps 54 (shown in FIG. 7), each of which has opposed ends with connecting means for releasably connecting together the opposed ends. The preferred connecting means comprise hook and loop type fasteners (not shown), whereby a hook type fastener is provided at one end of the strap and a loop type fastener is provided at the other end of the strap. By tightly wrapping the straps 54 about the container 12, the contents of the container (the cover, the rack, and the legs) are secured within the cavity of the container for transportation and storage of the apparatus.

To facilitate transportation of the apparatus when it is in its knocked down formation, a handle 62 is provided on at least one of the sidewalls 24 of the container 12. The handle allows a user to carry the apparatus with one hand, while carrying other materials with the other hand. Because the apparatus folds into a compact knocked down formation for transportation, it is unnecessary to utilize a full-size van to transport the apparatus 10. It may easily fit into the trunk or back seat of a car, while food is transported separately in the same or different vehicle.

It is to be understood that the present invention is not limited to the embodiments described above, but encompasses any and all embodiments within the scope of the following claims.

I claim:

1. A portable knockdown display apparatus for displaying food and keeping the food fresh on ice, the apparatus comprising:

a plurality of legs, each of said plurality of legs having opposed ends;

a container having a bottom and a plurality of sidewalls integral with said bottom, said bottom and said sidewalls defining a cavity adapted to retain ice during use of the apparatus, said container also having a plurality of attaching means for releasably attaching each of said plurality of legs to said container during use of the apparatus;

said plurality of legs supporting said container above a relatively horizontal surface during use of the apparatus;

a rack adapted to support a multiplicity of food receptacles, said rack being separable from said container and positioned within said cavity of said container during use of the apparatus;

a cover removably seated on said rack during use of the apparatus; and securing means for removably securing said rack, said cover, and said plurality of legs within said cavity of said container during transportation and storage of the apparatus.

2. The apparatus according to claim 1, said rack having a pair of opposed end rails, a plurality of spaced longitudinal rails extending between and connected to said end rails, and a multiplicity of support rails mounted upon adjacent longitudinal rails of said plurality of longitudinal rails, a pair of said multiplicity of support rails being adapted to support one of said multiplicity of food receptacles.

3. The apparatus according to claim 2, wherein each of said multiplicity of support rails is detachably and slidably mounted upon said adjacent longitudinal rails.

4. The apparatus according to claim 1, wherein said cover comprises a collar for contacting said rack and a transparent dome extending upwardly from said collar, said dome having a first lid hingedly attached to said dome for manipulation between a closed position and an open position.

5. The apparatus according to claim 4, wherein said dome further comprises a second lid hingedly connected to said dome for manipulation between a closed position and an open position.

6. The apparatus according to claim 5, wherein each of said first and second lids is provided with a lid handle.

7. The apparatus according to claim 1, wherein said plurality of attaching means comprises a plurality of attachment wells.

8. The apparatus according to claim 7, wherein each of said plurality of attachment wells has an inner dimension corresponding to the perimeter of each of said plurality of legs, each said attachment well frictionally receiving one of said legs.

9. The apparatus according to claim 7, wherein each of said plurality of legs has a threaded outer diameter at one end thereof; and each of said plurality of attachment wells has a threaded inner diameter for threadably receiving said threaded outer diameter on each of said plurality of legs.

10. The apparatus according to claim 7, wherein each of said plurality of attachment wells extends within the cavity of said container and has an upper surface, said rack resting directly upon said upper surface on each of said attachment wells during use of the apparatus.

11. The apparatus according to claim 1, wherein said bottom of said container has an opening therethrough; and said bottom sloping downwardly toward said opening from each of said plurality of sidewalls.

12. The apparatus according to claim 11, further comprising stopping means for stopping said opening in said bottom of said container.

13. The apparatus according to claim 1, wherein said container has a container handle on at least one of said sidewalls for carrying said container during transportation of the apparatus.

14. The apparatus according to claim 1, wherein said securing means comprises at least one strap having opposed ends with connecting means for releasably connecting together said opposed ends.

15. The apparatus according to claim 14, wherein said connecting means comprise a first connector on one of said opposed ends and a second connector on the other of said opposed ends.

16. The apparatus according to claim 1, wherein said sidewalls of said container form a rectangular shape.

* * * * *